United States Patent [19]

Thorneburg et al.

[11] Patent Number: 4,865,205

[45] Date of Patent: Sep. 12, 1989

[54] HOSIERY DISPLAY BOARD

[75] Inventors: James L. Thorneburg, P.O. Box 5440, Statesville, N.C. 28677; Ilan Plawker, Englewood Cliffs, N.J.

[73] Assignee: James L. Thorneburg, Statesville, N.C.

[21] Appl. No.: 549,412

[22] Filed: Nov. 7, 1983

[51] Int. Cl.[4] ..... A47F 7/00

[52] U.S. Cl. ..... 211/59.1; 211/13

[58] Field of Search ..... 211/59.1, 54.1, 57.1, 211/193, 190, 13; 312/108, 263, 264; 206/493; 248/309.2

[56] References Cited

U.S. PATENT DOCUMENTS

| | | | |
|---|---|---|---|
| 1,161,955 | 11/1915 | Nicholas | 211/59.1 |
| 3,752,553 | 8/1973 | Bildahl et al. | 312/111 X |
| 4,066,169 | 1/1978 | Hochman | 211/57.1 |
| 4,120,551 | 10/1978 | Godtschalch | 312/263 X |
| 4,183,522 | 1/1980 | Killen | 211/105.1 X |
| 4,257,522 | 3/1981 | Thorneburg | 206/299 |
| 4,344,540 | 8/1982 | Marschak | 248/220.3 X |

FOREIGN PATENT DOCUMENTS

| | | | |
|---|---|---|---|
| 2447032 | 4/1976 | Fed. Rep. of Germany | 211/54.1 |

*Primary Examiner*—Blair M. Johnson

*Attorney, Agent, or Firm*—Bell, Seltzer, Park & Gibson

[57] ABSTRACT

A plurality of packages of socks is displayed on elongate hanger elements by the present display board. A sock package retaining rail is connected at opposite ends to opposite side portions of the display board and the medial portion extends across and confines the sock packages within the retaining rail. The retaining rail is of a sufficient width to support advertising material thereon and is sufficiently narrow that the upper and lower portions of the sock packages are exposed to view by prospective purchasers. The sock package retaining rail confines the sock packages and protects the same from being dislodged or accidentally removed from the hanger elements. The display board is fabricated in such a manner that it may be economically shipped in a knock-down condition and can be quickly and easily assembled at the location where it is to be used.

8 Claims, 2 Drawing Sheets

HOSIERY DISPLAY BOARD

FIELD OF THE INVENTION

This invention relates generally to a hosiery display board and more particularly to a merchandising display for attractively displaying a plurality of packaged socks in a neat and orderly manner.

BACKGROUND OF THE INVENTION

It has been the practice to display packaged socks by hanging the same on horizontally extending pins supported at their inner ends in a pegboard or the like. Packaged socks displayed in this manner are subject to being easily removed from the supporting pins and they may be accidentally dislodged by prospective purchasers passing the displays in the aisles or the like. Also, packaged socks displayed in this manner are not easily maintained in groups with other similar types of socks for the most efficient selection by the prospective purchaser. It is also difficult to provide the proper type of advertising and use information adjacent socks when displayed in a more or less random manner on a pegboard or the like.

SUMMARY OF THE INVENTION

With the foregoing in mind, it is an object of the present invention to provide a packaged sock display board with spaced-apart hanger elements on which the packaged socks are supported in a vertical position. A sock package retaining rail is spaced below the hanger elements and extends across the sock packages with opposite ends connected to opposite side portions of the display board to protect and prevent accidental removal of the sock packages from the hanger elements. The reta is of a sufficient width to support suitable advertising and use information material thereon to identify the types of socks which are included in the display. The retaining rail is spaced below the hanger elements a sufficient distance that the upper portions of the sock packages are visible to the prospective purchaser. It is also preferred that the retaining rail be sufficiently narrow that the lower portions of the sock packages extend downwardly below the lower edge so that they are also exposed to view by prospective purchasers.

The present display board is particularly adapted for use with sock packages which include a pair of athletic socks with a support band extending across the front and the sides of the medial portions of the socks, a support panel extends across the rear and upwardly along the socks, and means is associated with the upper end of the support panel for supporting the sock package on elongate hanger elements extending horizontally from the upper portion of the display board. The hanger elements are of a sufficient length to support a plurality of the sock packages thereon and have an outer free end for receiving and removing the support means of the sock packages. The sock package retaining rail is preferably U-shaped and includes a medial portion extending in front of the sock packages and with opposite ends or legs being connected to opposite side portions of the display board.

It is preferred that the elongate hanger elements be substantially T-shaped in cross-section and that the upper end of the support panel of the sock package be provided with a corresponding T-shaped opening or slot. It is also preferred that the display board, the hanger elements, and the retaining rail be molded of plastic material. These elements of the display board are fabricated in such a manner that they can be shipped in a flat, knock-down condition and easily assembled at the location where the socks are to be merchandised. To this end, the display board is provided with spaced-apart locking slots extending across the upper portion thereof for receiving integrally molded hooked locking fingers on the inner ends of the elongate hanger elements. Hanger stabilizing plates are integrally molded adjacent the locking fingers for flush engagement with the face of the display board to stabilize the elongate hanger elements in both the horizontal and vertical directions. The sock package retaining rail includes a molded medial portion or rail adapted to extend between opposite sides of the display board and separate opposite side portions or rails extending at right angles to the medial portion. Connecting means is associated with the forward ends of the opposite side rails and opposite ends of the medial rail for connecting the same together in right angular relationship. Hooked locking fingers are provided on the inner ends of the side rails for engagement with locking slots in the lower portion of opposite sides of the display board. The medial portion of the hosiery package retaining rail is provided with means for releasably retaining an advertising and use information card therein.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
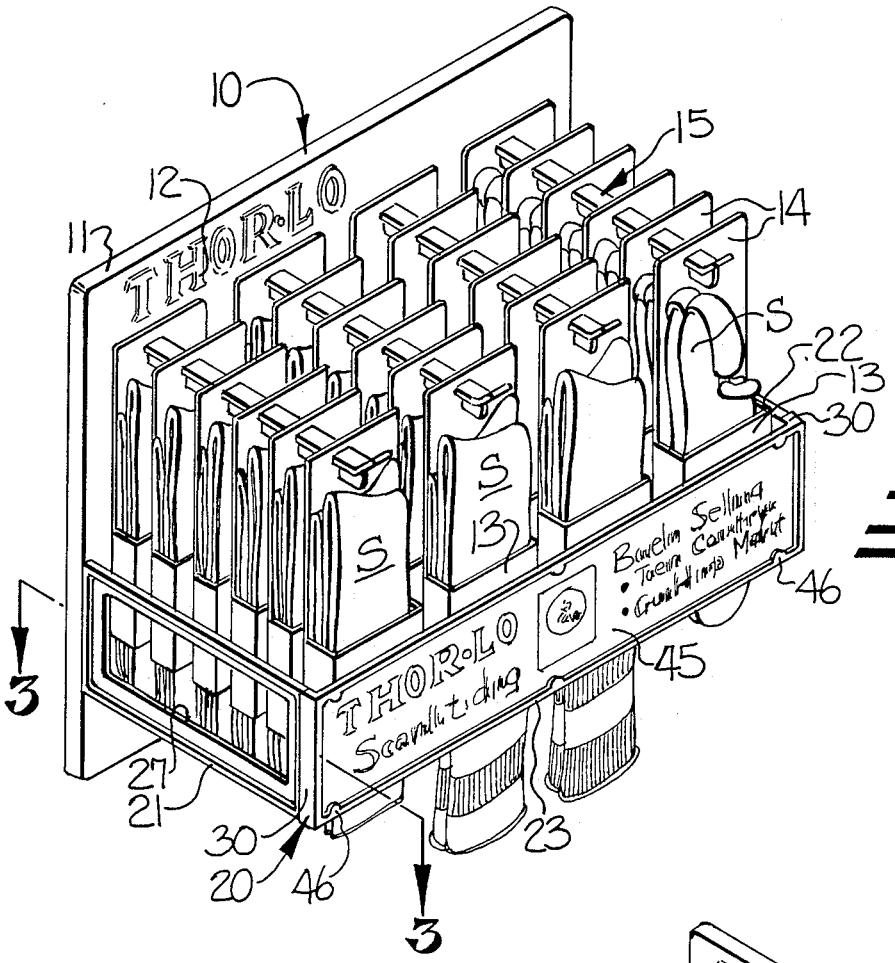
FIG. 1 is an isometric front view of the display board illustrating four rows of six sock packages being displayed thereby.

As illustrated in the drawings, the rectangular merchandising display board, broadly indicated at 10, is preferably formed of molded plastic and is provided with an integrally molded peripheral rim 11. The board 10 may be provided with an integrally molded brand or manufacturer name, as indicated at 12. The board 10 may be supported in a vertical position on a wall, display rack or the like and may be supported adjacent similar display boards for displaying a plurality of different types, sizes, and styles of packaged hosiery. The hosiery articles are illustrated as being various types of athletic socks with a pair of socks being displayed and supported in each sock package. The sock packages illustrated in FIG. 1 are of the same general type as that disclosed in U.S. Pat. No. 4,257,522 in which a support band 13 extends across the front and along the sides of the medial portions of the pair of socks, indicated at S. A support panel 14 extends across the rear and upwardly along the rear of the pair of socks S with the upper end being provided with support means, in the form of a T-shaped opening, for supporting the sock packages on the display board.

Figure 6:
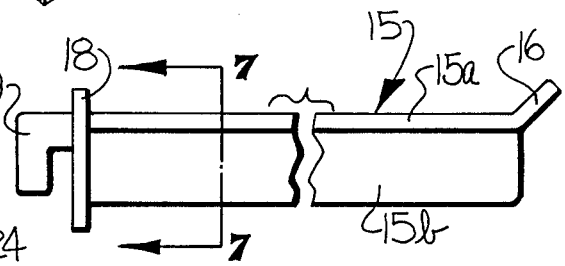
FIG. 6 is a side elevational view of one of the elongate hanger elements removed from the display board and with the central portion broken away.
Figure 7:
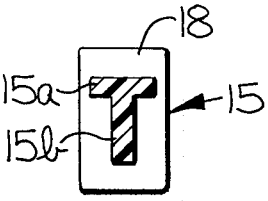
FIG. 7 is a vertical sectional view taken substantially along the line 7—7 in FIG. 6.

Elongate hanger elements, broadly indicated at 15, have their inner ends supported in spaced-apart relationship on the upper portion of the display board 10 and extend horizontally therefrom. Each of the hanger elements 15 is of sufficient length to support a plurality of sock packages, illustrated as six packages in FIG. 1, and are provided with a free end for receiving and removing the support means of the sock packages. As best illustrated in FIGS. 6 and 7, the hanger elements 15 are T-shaped in cross section and include a horizontal rib 15*a* and an integrally formed vertical rib 15*b* with an upturned outer free end 16 which prevents the sock packages from easily slipping off of the outer ends thereof.

Figure 4:
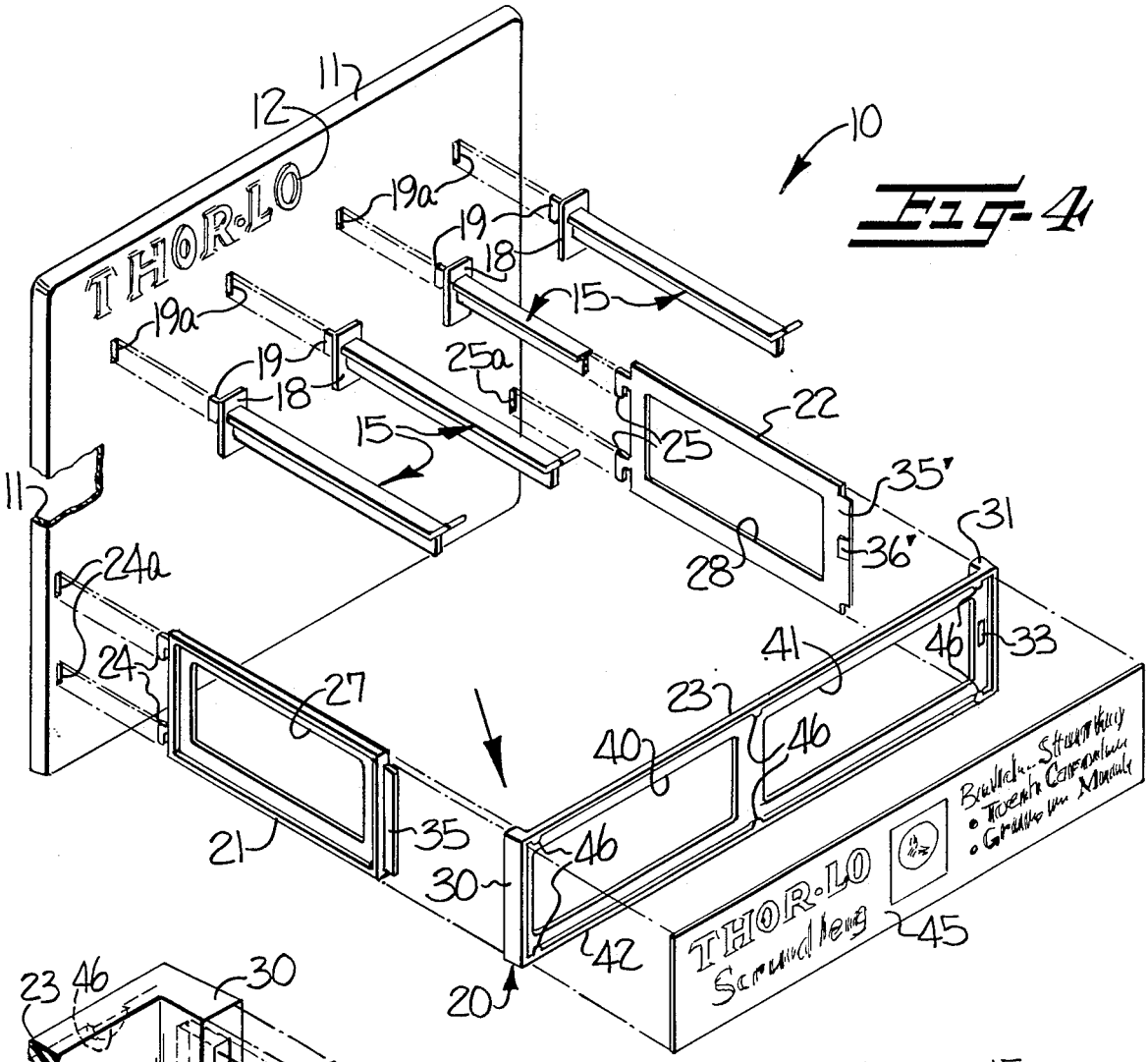
FIG. 4 is an isometric view of the display board with the parts is exploded or separated condition and with a portion of the display board being broken away to illustrate its configuration.

The inner end portion of the hanger element 15 is provided with an integrally molded hanger-stabilizing support plate or collar 18 and an integrally formed hooked locking finger 19. The locking finger 19 of each hanger element 15 is dimensioned to pass into and mate with corresponding locking support slots 19*a* spaced across the upper portion of the display board 10 (FIG. 4). When the locking finger 19 of a hanger element 15 is inserted in the corresponding locking slot 19*a* and the hanger element 15 is lowered, the hanger element 15 is maintained in a locked, horizontal position. The inner surface of the stabilizing plate or collar 18 is positioned and held against the face of the display board 10 and prevents movement of the outer end of the hanger element 15 in either the horizontal or vertical direction.

A sock package retaining rail, broadly indicated at 20, is connected at opposite ends to opposite side portions of the lower portion of the display board 10 and the medial portion extends across and around the medial portions of the sock packages. It is preferred that the sock package retaining rail 20 be formed in three interconnected pieces including one side portion or rail 21, a second side portion or rail 22, and a medial portion or rail 23 extending between the opposite side rails 21 and 22 and connected thereto. The inner ends of the side rails 21, 22 are provided with respective pairs of hooked locking fingers 24, 25 which are adapted to fit into and lock in position in respective locking slots 24*a*, 25*a* (FIG. 4) formed at opposite sides of the display board 10. The side rails 21, 22 are preferably provided with respective molded openings 27, 28 which permit an unobstructed view of the sock packages disposed inside of these respective rails.

Figure 5:
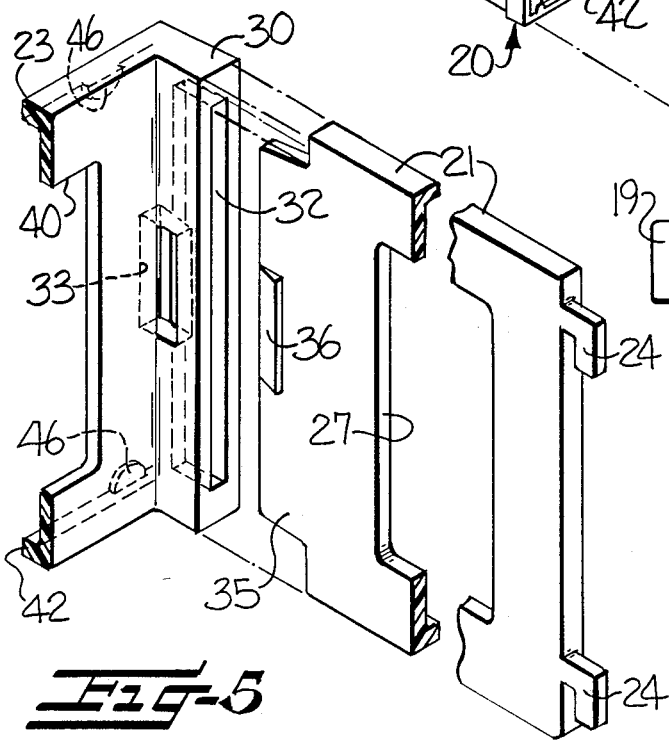
FIG. 5 is an exploded fragmentary isometric view of one end of the medial rail and a corresponding side rail, taken in the direction of the arrow 5 in FIG. 4.

The medial rail 23 is adapted to be easily attached to the outer ends of the side rails 21, 22 and to this end, integrally molded right angular connector legs 30, 31 are provided on opposite ends thereof and extend rearwardly therefrom. The connection means associated with the legs 30, 31 are identical and only the connection means associated with the leg 30 will be described in detail (FIG. 5) and like parts associated with the leg 31 will bear the same reference characters with the prime notation added. The connector leg 30 is provided with a longitudinally extended molded slot 32 which extends inwardly in a slightly inwardly tapering manner to substantially the same level as the inner surface as the medial rail 23. A relatively short and vertically extending molded locking slot 33 extends inwardly from the front surface of the medial rail 23. The locking slot 33 is in the medial portion of the medial rail 23 and its inner end joins the slot 32. The outer end of the side rail 21 is provided with an elongated locking tongue 35 which is tapered inwardly on opposite sides very slightly to match the taper of the slot 32. A tapered locking key 36 is integrally molded on the inner surface of the locking tongue 35 and is dimensioned to mate with and lock against the inner end of the slot 33 when the side rail 21 is pressed into the locking leg 30 of the medial rail 23, as illustrated in FIG. 3.

The medial rail 23 is preferably provided with a pair of molded openings 40, 41 and it is preferred that the medial rail 23 be of a sufficient width to support advertising material thereon. To this end, the outer surface of the medial rail 25 is provided with an integrally formed and outwardly extending peripheral rib or ledge 42 for receiving an advertising card, as indicated at 45 (FIG. 4). The card 45 may contain illustrations of the type of socks displayed on the display board, may include information relative to size and use of the particular type of sock, and any other consumer information which may be desired.

Figure 3:
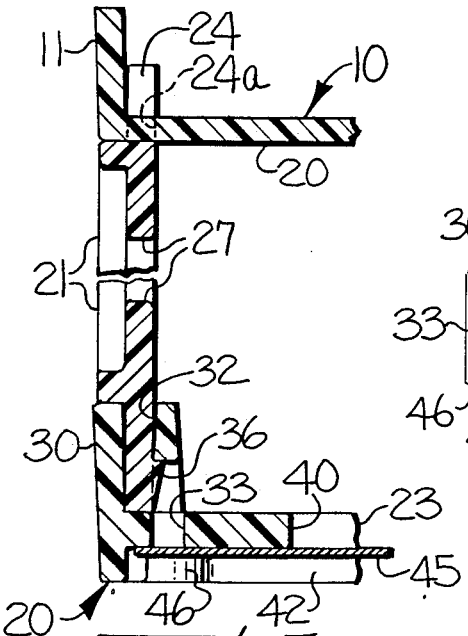
FIG. 3 is an enlarged horizontal sectional view taken substantially along the line 3—3 in FIG. 1 and with the central portion being broken away.
Figure 2:
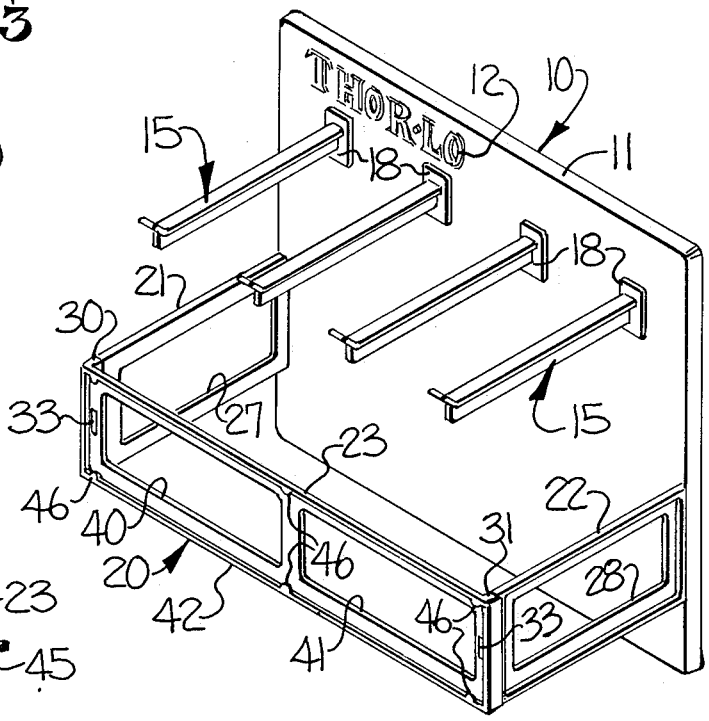
FIG. 2 is an isometric elevational view of the display board looking at the opposite side from that shown in FIG. 1 and with the sock packages and the advertising and use information card removed therefrom.

The upper and lower edges of the ledge 42 are provided with three spaced-apart detents 46 which extend inwardly from the upper and lower surfaces of the ledge 42 and are adapted to receive and retain the advertising card 45 therebehind, as illustrated in FIGS. 1 and 3. While it is preferred that the sock package retaining rail 20 be sufficiently wide to support suitable advertising material thereon, it is also preferred that the sock package retaining rail 20 be sufficiently narrow that the upper and lower portions of the socks in the sock packages are exposed to view by prospective purchasers. Thus, the sock package retaining rail 20 serves several purposes, that is, to surround, confine and protect the sock packages from being accidentally dislodged or engaged by consumers or the like, is sufficiently wide to support advertising or other information regarding the socks contained in the display board, and yet is narrow enough that it does not obstruct the view of the socks being displayed.

The present display board is fabricated in such a manner that it may be shipped in a flattened or "knock-down" condition and can be easily erected or assembled at the site where it is to be used. To assemble the display board, it is merely necessary that the inner ends of the elongate hanger elements 15 be aligned with the slots 19*a* and the hooked locking fingers 19 be positioned therein. The hooked locking fingers 24, 25 at the inner ends of the respective side rails 21, 22 are then inserted into the corresponding slots 24*a*, 25*a* in the display board 10. The locking legs 30, 31 of the medial rail 23 are inserted onto the corresponding locking tongues 35, 35' so that the locking keys 36, 36' engage the corresponding locking slots 33 in the respective locking legs 30, 31. The sock packages may then be hung on the hanger elements 15, as illustrated in FIG. 1 and the advertising card 45 is inserted behind the detents 46 to properly describe and illustrate the type of socks being displayed.

In the drawings and specification there has been set forth the best mode presently contemplated for the practice of the present invention, and although specific terms are employed, they are used in a generic and descriptive sense only, and not for purposes of limitation, the scope of the invention being defined in the claims.

That which is claimed is:

1. A rectangular merchandising display board adapted to be supported in a vertical position for displaying a plurality of hosiery packages thereon, each of said hosiery packages including a pair of hosiery articles and a support band extending across the front and along the sides of the medial portions of the hosiery articles, a support panel extending across the rear and upwardly along the hosiery articles, and means associated with the upper end of said support panel for supporting said hosiery package on said display board, said merchandising display board including a. a plurality of elongate hanger elements having inner ends supported in spaced-apart relationship on the upper portion of said display board and extending horizontally therefrom, each of said hanger elements being of sufficient length to support a plurality of said hosiery packages thereon and having a free end for receiving and removing said support means of said hosiery packages, and b. a U-shaped hosiery package retaining rail spaced below said hanger elements and including a medial portion extending between opposite sides of said display board and including upper and lower edges, and opposite side portion extending at right angles to said medial portion, said opposite side portions having outer ends connected to opposite ends of said medial portion and inner ends connected to opposite side portions of the lower portion of said display board, said upper edge of said medial portion of said hosiery package retaining rail being spaced below said elongate hanger elements and at all same level as the upper edge of said support band of said hosiery packages, said medial portion of said hosiery package retaining rail being of a sufficient width so that said retaining rail extends across a medial portion of said vertically supported hosiery packages with the upper and lower portions of the hosiery articles in said hosiery packages being exposed to view by prospective purchasers, said hosiery package retaining rail surrounding, confining and protecting the hosiery packages from being accidentally dislodged or engaged by prospective purchasers.

2. A merchandising display board according to claim 1 including means for removably connecting the inner ends of said hanger elements to said display board and comprising a hooked locking finger on the inner end of each of said hanger elements, and spaced-apart locking slots formed in said display board and adapted to lockingly receive said locking fingers and support said hanger elements in a position extending horizontally therefrom.

3. A merchandising display board according to claim 1 wherein each of said hanger elements is T-shaped in cross section, and said support means of said hosiery packages comprises a T-shaped slot adapted to fit on said hanger element.

4. A merchandising display board according to claim 1 wherein said display board, said hanger elements, and said hosiery package retaining rail are each formed of molded plastic.

5. A merchandising display board according to claim 1 including a hanger stabilizing collar extending outwardly form the inner end portion of each of said hanger elements, said hanger stabilizing collar being engageable with the face of said display board when said hooked locking finger is engaged in said locking slot to prevent movement of said hanger element in either the horizontal or vertical direction.

6. A merchandising display board according to claim 1 wherein the inner ends of said opposite side portions of said retaining rail include means for removably connecting said retaining rail to said display board, said connecting means comprising hooked locking fingers on the inner ends of each of said opposite side portions, and locking slots formed in said display board and adapted to lockingly receive said locking fingers and support said retaining rail in a substantially horizontal position.

7. A merchandising display board according to claim 6 wherein opposite ends of said medial portion of said retaining rail include inwardly extending connector legs with elongated slots therein, and wherein the outer ends of said opposite sides include locking tongues adapted to fit into and lock with said elongated slots in said connector legs.

8. A merchandising display board according to claim 1 including means on said medial portion of said retaining rail to removably support an advertising card thereon.

* * * * *

UNITED STATES PATENT AND TRADEMARK OFFICE

CERTIFICATE OF CORRECTION

PATENT NO. : 4,865,205

DATED : September 12, 1989

INVENTOR(S) : James L. Thorneburg and Ilan Plawker

It is certified that error appears in the above-identified patent and that said Letters Patent is hereby corrected as shown below:

Column 1, line 36, "reta" should be -- retaining rail --.

Column 5, line 32, "portion" should be -- portions --; line 40, "all" should be -- the --.

Column 6, line 23, "form" should be -- from --.

Signed and Sealed this

Twenty-fourth Day of July, 1990

*Attest:*

HARRY F. MANBECK, JR.

*Attesting Officer*

*Commissioner of Patents and Trademarks*